United States Patent [19]

Walter

[11] Patent Number: 4,555,435

[45] Date of Patent: Nov. 26, 1985

[54] INTERCHANGEABLE IDENTIFICATION APPARATUS FOR RACING ANIMALS AND EVENT CONTESTANTS AND METHOD FOR MAKING SAME

[76] Inventor: Ernest J. Walter, 2913 Caldwell Ave., Ontario, Calif. 91761

[21] Appl. No.: 575,078

[22] Filed: Jan. 30, 1984

[51] Int. Cl.[4] ..... B68C 1/12; G09F 3/08; G09F 7/08

[52] U.S. Cl. ..... 428/79; 2/DIG. 6; 54/65; 54/79; 156/91; 156/293; 428/52; 428/100; 428/102; 428/138

[58] Field of Search ..... 428/100, 7, 79, 52, 428/102, 138; 2/1, DIG. 6; 40/300, 303; 54/65, 79; D6/603, 608; 156/91, 293

[56] References Cited

U.S. PATENT DOCUMENTS

| | | | |
|---|---|---|---|
| 373,764 | 11/1887 | Ayres | 54/79 |
| 2,685,690 | 8/1954 | Chrisman | 2/1 X |
| 3,202,193 | 8/1965 | Ware | 428/52 X |
| 3,310,091 | 3/1967 | Geisen et al. | 428/100 X |
| 3,466,852 | 9/1969 | Stoner | 428/153 X |
| 3,484,974 | 12/1969 | Culmone | 428/100 X |
| 4,224,712 | 9/1980 | Black et al. | D6/608 X |
| 4,249,268 | 2/1981 | Berler | 428/100 X |
| 4,448,560 | 5/1984 | Monaco, Jr. | 428/100 X |

OTHER PUBLICATIONS

Dritz Velcro Tape Fasteners, 2 pages.
Velcro Product News Jul. 1977, 4 pages.

*Primary Examiner*—Henry F. Epstein
*Attorney, Agent, or Firm*—Blakely, Sokoloff, Taylor & Zafman

[57] ABSTRACT

An apparatus and method for identifying race contestants and racing animals incorporating a detachable and interchangeable is described. The body of the label is detachably secured to the front of a piece of supporting material, such as a horse's saddle towel. The ends of the label are passed through slots in the saddle towel proximate to the corners thereof and are secured to the back of the saddle towel. This ensures that the label remains securely in place on the saddle towel, and remains flush and aligned therewith during the racing event so that the name or other identification is clearly visible to spectators.

10 Claims, 3 Drawing Figures

INTERCHANGEABLE IDENTIFICATION APPARATUS FOR RACING ANIMALS AND EVENT CONTESTANTS AND METHOD FOR MAKING SAME

BACKGROUND OF THE INVENTION

1. Field of the Invention

The invention relates to an interchangeable identification apparatus and method for use on race horses, racing dogs, and the like, having an easily detachable identification label attached thereto.

2. Description of the Prior Art

A wide variety of means for identifying event contestants and racing animals are known in the prior art. Typically, prior art identification systems incorporate a number, name, or other identifying symbol which is a permanently affixed to cloth, paper, or plastic and is spinned or otherwise secured to the contestant during the event. Therefore, detachment of the identifying name or symbol from its carrying material is not possible.

However, for certain types of sporting events there can be particular practical and economic advantage to providing an identification system in which the name or symbol can be detached from the carrying material upon which it is displayed. Such a system would be especially desirable for use in identifying racing horses during horse races. In horse racing, horses are typically identified by a number that is permanently sewn onto the horse's saddle towel, which is a cloth blanket that drapes over the horse and hangs down over to each side of the horse's torso. The identifying numbers are disposed on opposite sides of the saddle towel and are sufficiently large and colorful so that they are clearly visible to the spectators in the stadium. The saddle towels are usually owned and maintained by each race track.

When a particular horse is entered in a race, it is assigned an identifying number and provided with a saddle towel bearing the assigned number. In that way, each horse in a given race bears a different number. These assigned numbers also are used to identify the respective horses in the race track program booklet, betting system, announcements and reports, newspapers, daily racing forms, and the like. The identifying numbers are not typically detachable from the saddle towel.

Further, the horse's name does not appear on the saddle towel, even though the horse is identified by name in the spectator's program booklet and by the track announcer. Consequently, in order for spectators to visually identify a race horse by association with its name, it is necessary for them to refer to the indexes of the reference materials available at the race track, search for the particular race in question and locate name associated with the horse's number. Additionally, as described above, each horse's number is typically assigned based on its assigned position at the gate. The horse is then provided with a saddle towel bearing that number prior to the race. If personalized saddle towels were provided, it would be necessary to permanently affix the personalized name label to its saddle having the assigned number for each horse for each race. This would be both impractical and prohibitively expensive. Presently, "personalized" saddle towels bearing the horse's name are used only in prestigous championship races.

SUMMARY OF THE INVENTION

The present invention relates to an efficient and economical interchangeable apparatus and method for identifying racing animals or event contestants. While it will be appreciated that this invention can be used for all types of racing animals and for human contestants, it will be described herein in connection with horse racing for which it is particularly well suited. In the present invention, each horse can be provided with personalized detachable labels with the horses name printed separately on each label. The race track, as in the prior art system, owns and maintains the numbered saddle towels. However, in the present invention, the saddle towels are provided with a novel and inexpensive means for attaching the personalized name labels thereto, so that the labels are clearly visible to the spectators, and are easily interchanged with a different assigned saddle towel. In addition, the entire apparatus is completely washable, so it can be easily maintained for long periods without the necessity of replacement.

The labels are preferably attached along the bottom sides of the saddle towel on both sides of the horse. The middle section of each label is attached to the saddle towel. The ends of each label are passed through slots in the saddle towel and are secured to the corners on the back side of the saddle towel using a detachable fastening means such as snaps or hook and loop fasteners.

It is, therefore, one object of the present invention to provide an interchangeable means for labelling a racing horse's saddle towel with the individual name of the race horse.

It is a further object of the present invention to provide an efficient, interchangeable labelling means for use on contestants in sporting events.

It is yet another object of the present invention to provide a labelling means which can be securely affixed to a saddle towel which is easily attached thereto and removable therefrom.

DETAILED DESCRIPTION OF THE INVENTION

Figure 1:
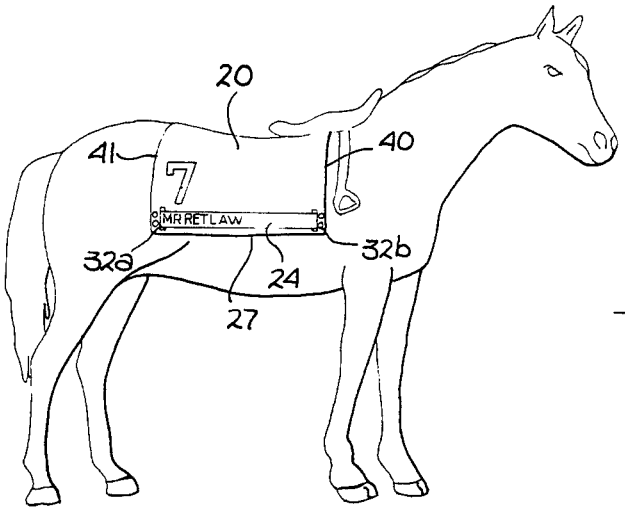
FIG. 1 is a side view of the invented interchangeable labelling apparatus shown mounted on a horse.
Figure 2:
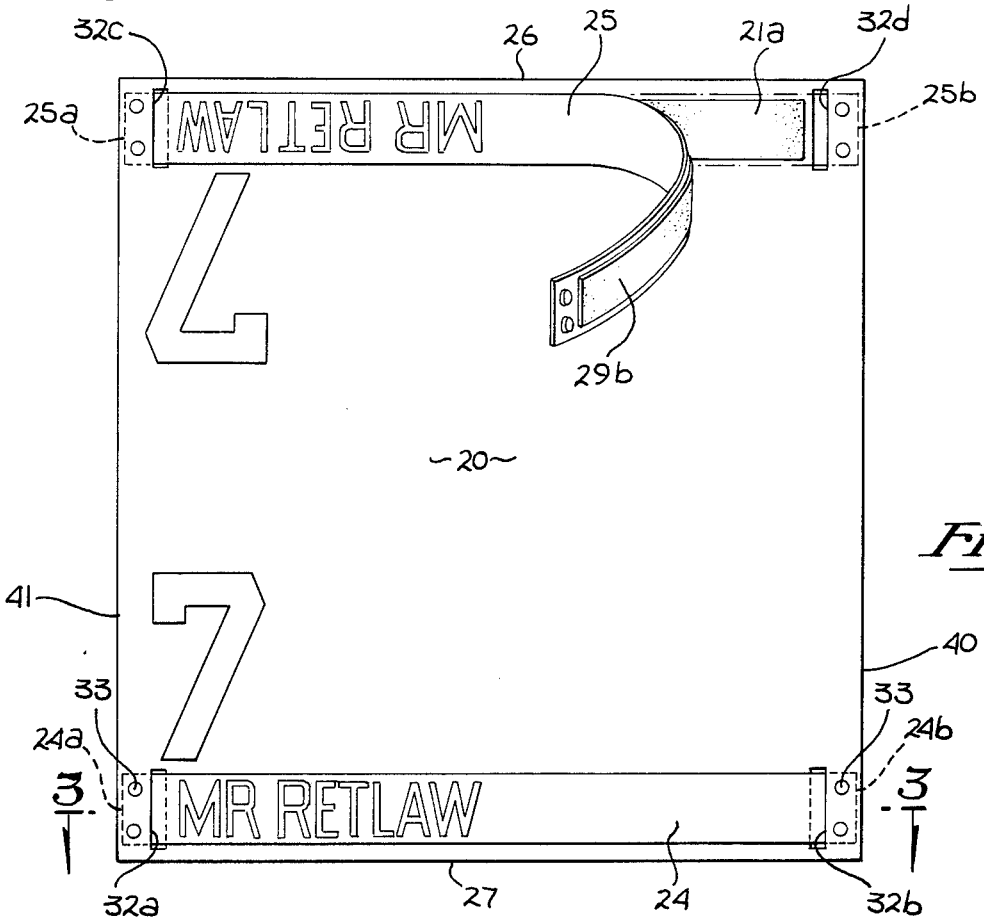
FIG. 2 is a plan view of the invented interchangeable labelling system with one labelling means partially installed thereon.

Referring generally to FIG. 1, an apparatus with a detachable label for displaying the horse's name is shown. A saddle towel 20, made of a flexible and resilient sheet of fabric material, drapes over the torso of the horse. Although its overall dimensions may vary for the size of the animal, dimensions 40 inches ×40 inches have been selected for the application described. Rectangular slots 32*a, b, c* and *d* are provided near each corner of the saddle towel substantially parallel with and adjacent to the front and back edges 40 and 41 of the saddle towel along its lower edges 26 and 27. Alternatively, the slots may be provided anywhere along the lower edges of the saddle towel as may be optimal for a particular application. The slots are designed to receiveably engage the ends 24*a* and 24*b* and 25*a* and 25*b* of the labels 24 and 25 respectively, such that the ends of each label can be passed easily through the slots, and will be supported thereby once fully in position.

Each label 24 and 25 is a unitary strip of fabric material having a substantially rectangular shape. The label ends are reinforced by adding a double thickness of fabric or other suitable reinforcement thereto to provide a sufficiently stiff surface such that the ends can be easily handled and press engaged onto the saddle towel.

The upper surface 29*a* of each reinforced end of the label incorporates an adhesive or other fastening means 33 for removeably securing the label to the lower surface 21*b* of the saddle towel between the outer edge of the slots and the adjacent side of the saddle towel. In the present preferred embodiment, a hook and loop fastener such as Velcro® manufacturered by Velcro, Inc. of Manchester, N.H. is used, because the label can be quickly and easily secured to the saddle towel using such fastening means, yet can be detached therefrom with equal facility.

Suitable fastening means are also provided along the lower surface 29*b* of the label for securing it to the upper surface 21*a* of the saddle towel along its lower edges 26 and 27 between each pair of slots. For reasons already described in the preferred embodiment, Velcro® is also used for this application. However, various alternative fastening means well known in the art, such as metal snaps 39, or the like, can be substituted for, or used in combination, with Velcro for this purpose.

Figure 3:
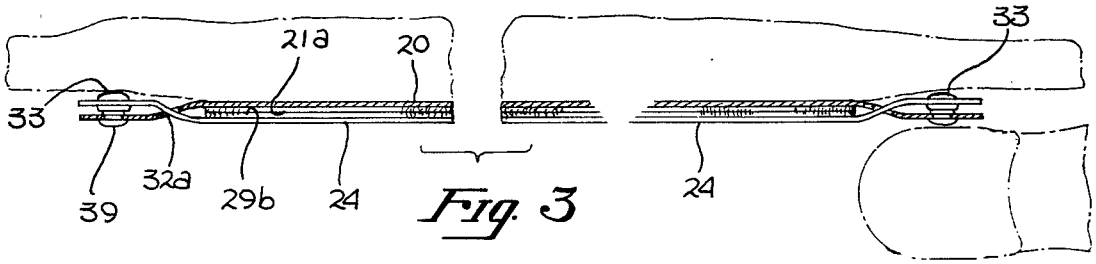
FIG. 3 is a sectional view of the invented interchangeable labelling apparatus in its installed condition illustrating one embodiment of the fastening means.

As shown in FIG. 1, and as further illustrated in FIG. 3, the saddle towel with label detachably secured thereto drapes over the horse's torso. Thus, the weight of the saddle towel, and the weight of the rider mounted on the horse, will exert a force component P perpendicular to the label thereby forcing the label toward the blanket and against the horse along the entire length of the label and, in particular, at its ends. Thus, the detachable label will not shake loose due to the vigorous oscillating forces that occur while the horse is in motion.

In an alternate embodiment of the present invention, a single slot arrangement for each label may be used. This arrangement is suitable for training runs and workouts where the label undergoes vibration that is less vigorous than that experienced during actual racing conditions.

The use of slots, combined with suitable fastening means and dual-surface fastening engagement, combines to prevent the label from being shaken loose or otherwise detaching from the saddle towel during the course of a race. This is of particular importance to the safety of both the horse and rider, because it prevents the flapping or hanging of the lable which could easily distract the horse and cause him to become wild, potentially injuring himself and his rider. Additionally, the present invention prevents the label from being dislodged from the saddle towel by the rider's foot upon mounting or while riding. The position of the rider and the weight of his body and legs against the saddle towel continuously provide an urgent perpendicular force against the fastening means to maintain the label securely in place. Accidental dislodgement of the label is thereby prevented, although the label can be easily detached from the saddle towel when desired. Thus, shear forces which would otherwise tend to loosen a label, particularly in view of the severe vertical and horizontal rocking motion of the rider and horse, will not dislodge the label from the saddle towel.

To attach a label to the saddle towel, the label, e.g. 24 is aligned between the slots 32*a* and 32*b* with the lettering of the label facing upward. The mating portions of the label and saddle towel are then press engaged. The ends 24*a* and 24*b* of the label are then passed through the slots 32*a* and 32*b* and press engaged with their mating portions of the fasteners on the underside of the towel.

It should be appreciated that various changes may be made in the details, arrangements, of the various parts of the present invention without departing from its scope. The present embodiment is therefore illustrative, and not restrictive. The scope of the present invention is indicated by the appended claims rather than by the foregoing description, and all changes which come within the meaning and range of equivalency of the appended claims are therefore intended to be embraced therein.

I claim:

1. A labelling apparatus with detachable label for providing spectator identification of animals comprising:

a flexible label having an upper surface for carrying information thereon, a lower surface, and a first and second end;

a carrier piece into which said label is attached and displayed, said carrier piece having an upper surface and a lower surface, and having at least one slot for receiving at least an end of said label and for passing said end therethrough, whereon said slot is disposed to provide upward support of said label and to provide for cooperative interface between the surface of said carrier piece and said label such that said label is urged against the surface of said carrier piece and the body of said animal by gravity and rider weight forces present thereon; a first fastening means for detachably securing said upper surface of said end to said lower surface of said carrier piece; and a second fastening means for removably securing said lower surface of said label to said upper surface of said carrier piece;

whereby said label is maintained flush and aligned with said carrier piece, and whereby said label is detachably secured thereto.

2. The labelling apparatus with detachable label as claimed in claim 1 further comprising reinforcing means for reinforcing said at least one end of said label.

3. The labelling apparatus with detachable label as claimed in claim 1 wherein said first and second fastening means comprises a hook and loop fastener.

4. A labelling apparatus with detachable label as claimed in claim 3 wherein said hook and loop fastener comprises Velcro.

5. The labelling apparatus with detachable label as claimed in claim 4 wherein said first fastening means comprises snap fasteners.

6. The labelling apparatus with detachable label claimed in claim 1 wherein said second fastening means provides continuous engagement of said lower surface of said label with said upper surface of said carrier piece along the length of said label between said slots.

7. The labelling apparatus with detachable label claimed in claim 1 wherein said carrier piece comprises a saddle towel.

8. A labelling apparatus with detachable label for providing spectator identification of horses comprising:

a flexible label having an upper surface for carrying information thereon, a lower surface, and a first and second end;

a saddle towel having an upper surface and a lower surface, and at least two slots for receiving the ends of said label and for passing said ends therethrough to provide upward support for said label, and disposed such that said position of said label disposed through said slots allows for urgent forces of gravity and rider weight to be directed perpendicular thereto against the body of the horse for maintaining the label securely in place; and fastening means fo detachably securing said label to said saddle towel;

whereby said label is maintained flush and aligned with said saddle towel in its installed condition, and is removably sewed thereto.

9. A labelling apparatus with detachable label claimed in claim 8 further reinforcing means for reinforcing said ends of said label.

10. A method for applying a flexible and interchangeable label onto a carrier piece for use on animals comprising the steps of:

(a) providing a label having an upper surface for carrying information therefrom, a lower surface, a central portion, first and second ends; and fastening means on the lower surface of said central portion and the upper surface of said ends;

(b) providing a carrier piece having an upper surface, a lower surface, and at least one pair of slots for receiving the ends of said label;

(c) aligning the lower surface of said central portion of said label with said upper surface of said carrier piece between said slots;

(d) press engaging the fastening means of said label to said fastener means of said carrier piece thereby securedly attaching the central portion of said label to said carrier piece flush and aligned therewith;

(e) passing the ends of said label through said slots;

(f) aligning a fastening means with the ends of said label and with said lower surface of said carrier piece adjacent to said slots; and (g) press engaging said fastening means on said ends of said label with said fastening means on said carrier piece adjacent to said slots thereby securely affixing said ends to said lower surface of said carrier piece.

* * * * *